United States Patent [19]

Gates

[11] 3,958,800

[45] May 25, 1976

[54] INCLINED PAPER FEED

[75] Inventor: Albert George Ronald Gates, London, England

[73] Assignee: Gestetner Limited, London, England

[22] Filed: Jan. 23, 1975

[21] Appl. No.: 543,310

[30] Foreign Application Priority Data

Jan. 24, 1974 United Kingdom ..... 3277/74

[52] U.S. Cl. ..... 271/126; 271/30 A; 271/149

[51] Int. Cl.[2] ..... B65H 1/10

[58] Field of Search ..... 271/30 A, 126, 129, 271/149, 150

[56] References Cited

UNITED STATES PATENTS

| | | | |
|---|---|---|---|
| 2,652,248 | 9/1953 | Johnson | 271/149 |
| 3,291,481 | 12/1966 | Godlewski | 271/149 |
| 3,434,711 | 3/1969 | Betschart | 271/149 |
| 3,527,458 | 9/1970 | Bond | 271/30 A |

*Primary Examiner*—John J. Love
*Assistant Examiner*—Robert Saifer
*Attorney, Agent, or Firm*—Fleit & Jacobson

[57] ABSTRACT

A sheet feed mechanism for feeding individual sheets from a stack thereof comprises a first generally horizontal surface for supporting the edge of a stack of sheets and a second surface for supporting a face of the stack, the second support surface being provided by a plate member supported above the first surface and inclined at an obtuse angle with respect thereto. The plate member is supported so that the second surface is urged towards the nip defined between the first support surface and a sheet feed roller in such a manner that as the second surface approaches the nip the obtuse angle increases. In a preferred embodiment a cam surface is provided on the plate member to adjust the rate at which the obtuse angle varies as the second surface approaches the nip. The preferred embodiment also includes means for adjusting the height of the nip defined between the sheet feed roller and the first support surface to permit feeding of different gauges of sheets.

9 Claims, 1 Drawing Figure

INCLINED PAPER FEED

Figure 1:
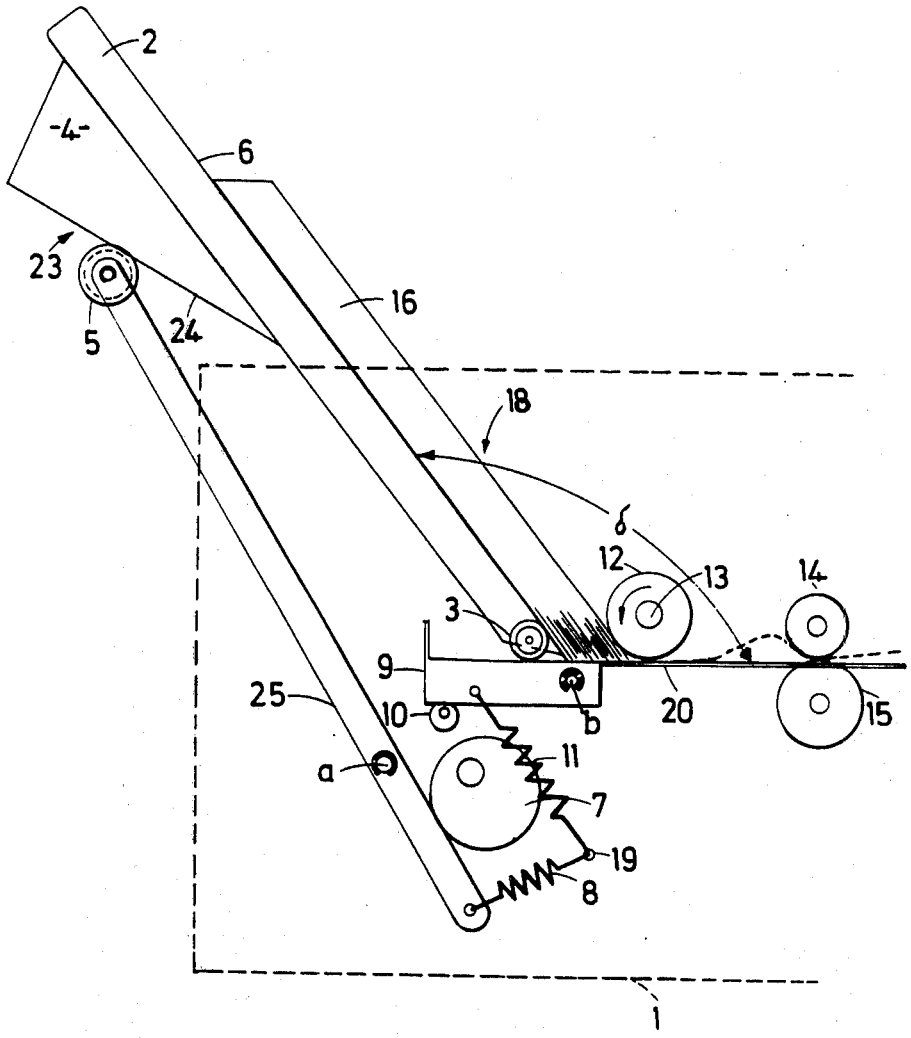

The present invention relates to a mechanism for feeding single sheets from a stack of sheets, and is particularly suitable for feeding sheets of paper from a stack of paper towards a processing station, for example in a stencil duplicator or other copier.

Heretofore mechanisms for feeding individual sheets from a stack towards the printing station of a stencil duplicator have usually required a table for the stack of sheets, an adjustable pressure feed member to engage the topmost sheet of the stack, and a biasing member to urge the paper into engagement with the feed roller. U.S. Pat. No. 2,652,248 discloses a sheet feed mechanism in which an inclined plate supports the edge of the stack of sheets and defines together with sheet feed rolls a nip through which sheets are advanced. A carriage is slidably mounted on the plate and is provided with a flat, inclined surface which suports a face of the stack.

The carriage and the stack of the sheets tend to move down the plate and hence towards the nip under the influence of gravity and thus as the stack becomes depleted the force biasing the top sheet towards the feed roller decreases giving a reduced friction feed force exerted on the top sheet by the roller. Under these conditions multiple feed is a common occurrence, and is of course highly undesirable.

It is the object of the present invention to provide an inclined stack feeder in which this disadvantage is mitigated.

According to the present invention there is provided a feed mechanism for feeding individual sheets from a stack, the mechanism including: a first support surface for supporting an edge of a stack of sheets; a rotatable sheet feed roller adjacent to said surface to define therewith a nip through which sheets may be fed, the axis of the sheet feed roller being parallel to said surface; a plate member above the first support surface and having a second support surface for a face of the stack of sheets, said second surface extending at an obtuse angle to the first support surface such that the feed roller is included within said obtuse angle and the lowermost part of the second surface being urged towards the nip between the sheet feed roller and the first support surface; and means adapted to support the plate member such that during advance of the plate member towards the sheet feed roller, said obtuse angle is varied so as to be inversely proportional to the spacing between the lowermost part of the second surface and the said nip.

Preferably the inclined plate member is provided with roller means at its lowermost end and is supported so that its own weight and that of the stack of sheets will create gravity biasing of the lowermost end of the plate member towards the feed roller so that the top sheet of the stack is in frictional contact with the feed roller.

The magnitude of the frictional force between the top sheet and the roller depends both on the coefficient of friction and the normal reaction therebetween. The normal reaction, of course, depends on the combined weight of the plate member and the stack of sheets and varies so that as the above-mentioned obtuse angle increases, do does the normal reaction.

In view of the above, and since the force required to separate the top sheet from the stack is dependent on the coefficient of friction between the top sheet and the remainder of the stack, the angle of inclination of the inclined plate member necessary to ensure efficient feeding of the sheets is dependent on the weight and nature of the sheets of the stack.

The separating force to be exerted on the top sheet to drag it into the nip between the sheet feed roller and the first support surface must be sufficient to overcome both the resistance of the leading edge of the sheet to being bowed into the nip and also the friction between the topmost sheet and the next adjacent sheet of the stack. For a larger value of the aforementioned obtuse angle, the degree of bowing of the sheets as they slide into the nip will be smaller. Hence for thick paper (i.e. stiff sheets) the angle should be less than for relatively thinner and flimsier paper. The inclination of the second support surface when feeding starts therefore needs to suit the paper. However, for a given separating force, corresponding to a given value of the normal reaction between the top sheet and the sheet feed roller, the aforementioned obtuse angle must be smaller when the combined weight of the stack and plate member is greater in order to compensate for the increased normal reaction which would be brought about by the combined weight if the angle of inclination were fixed.

For this reason, and since the combined weight of the stack and plate member decreases as the stack of sheets is depleted, the aforementioned obtuse angle should gradually increase to optimise the force applied to separate the top sheet from the remainder of the stack.

For example such an increase in the obtuse angle can be achieved if the upper end of the plate member is supported by a roller connected to a fixed support. However, it has been found that a more efficient feed of sheets may be obtained if the upper end of the plate member is provided with a cam surface, preferably one which is inclined to the said second support surface, which engages with a roller attached to a support since this facilitates a more desirable variation of the obtuse angle with the separation between the lowermost part of the second support surface and the nip.

Moreover, in order to adapt the mechanism for a particular sheet stiffness and sheet to sheet coefficient of friction it is desirable to provide means for varying the range of inclinations encountered in operation.

Accordingly, in a preferred embodiment in which the uppermost end of the plate member is provided with a cam surface in contact with the roller, the roller is supported at one end of a pivoted lever which is acted upon by an adjustable member such as a rotatable eccentric so as to permit variation in the position of the roller. The normal reaction between the sheet feed roller and the top sheet of the stack and hence the inclination of the plate member should be great enough to provide grip between the sheet feed roller and top sheet but not so great that the normal reaction exerted by the top sheet on the next adjacent sheet of the stack leads to grip between these two sheets or that the driving force on the top sheet is excessive and can cause creasing of the top sheet.

Preferably the first support surface is provided by a member which is pivoted and is engaged by an adjustable member such as an eccentric, thereby permitting adjustment of the separation of the sheet feed roller and first support surface. The member may advantageously be spring biased into contact with the eccentric so that the surface can move away from the roller against the spring biasing in the event of an accidental multiple feed. This adjustable pivoting arrangement allows the use of different gauges of paper since the spacing of the nip can be adjusted to give optimum driving engagement between the sheet feed roller and the top sheet of the stack.

In order that the present invention may more readily be understood, the following description is given, by way of example, reference being made to the accompanying drawing in which the sole Figure is a schematic side elevation of part of a stencil duplicator utilizing a mechanism according to the present invention.

In the Figure, a stack of paper 16 is supported on a sheet stack supporting surface 6 of an inclined plate member 2 which forms the rear wall of a sheet holder generally indicated by the reference 18. The lower edges of the sheets of the stack are supported by a bottom wall 20 of the sheet holder, the wall 20 being part of a sheet guide 9 which is pivoted at b to the frame 1.

Disposed adjacent the wall 20 and spaced from the surface 6, so as to contact the uppermost sheet of the stack, is a feed roller 12 rotatable about an axle 13 which is parallel to the surface of wall 20. A pair of cooperating feed rollers 14 and 15 are provided downstream of the roller 12 so as further to feed sheets separated from the stack by the feed roller 12.

Pivoting of the guide 9 about the pivot b allows for a variable separation between the sheet feed roller 12 and the bottom wall 20 so as to permit feeding of different gauges of paper. In order to adjust the pivotal position of the guide 9 an eccentric 10 is mounted to contact the lower wall of the guide 9 and a spring member 11 is connected between the guide 9 and a fixed point 19 in the duplicating machine so as to maintain the lower surface of the guide 9 in contact with the eccentric.

Movement of the plate member 2 providing the surface 6, is controlled by means of a first pair of wheels 3 disposed with one wheel on either edge of the plate member 2 (only one of the wheels being shown in the Figure), and a camming mechanism, generally indicated 23, which controls the position of the upper end of the plate member 2. The wheels 3 bear against the upper surface of the guide 9 and the lower edge of the plate member 2 is angled to prevent it bearing directly against the wall 20 of the guide 9. The camming mechanism 23 comprises a pair of rearwardly projecting cam slopes 4 fitted to the underneath of the plate member 2 near the top thereof with one slope adjacent each side edge of the plate member. Each cam slope 4 has associated therewith a roller 5 borne at one end of a lever 25 and engaging a cam surface 24 of the cam slope 4. The lever 25 is pivoted at a with the major portion of its length lying on the roller-carrying portion thereof. The shorter portion of the lever 25 is acted upon by an eccentric 7 so as to permit adjustment of the orientation of the lever 25, and a spring member 8 engages between the end of the lever 25 remote from the roller 5 and the fixed point 19 on the duplicator body so as to maintain the lever in contact with the eccentric 7.

In use of a duplicator provided with the above described sheet feed mechanism, a stack of sheets 16 is placed on the supporting surface 6, with the plate member 2 being initially urged to the left (as viewed in the Figure) in order to accommodate the height of the stack between the surface 6 and the roller 12. Either before or after the insertion of the stack 16, the eccentric 7 is adjusted in order to set the sheet-face supporting surface 6 at the required obtuse angle δ to the bottom wall 20 of the sheet holder 18 in order to ensure accurate feeding of single sheets by the roller 12. In addition at this stage the eccentric 10 may be adjusted in order that the spacing between the roller 12 and the bottom wall 20 may be adequate to allow passage of a single sheet therethrough without permitting the feeding of superposed sheets. The correct adjustment of the eccentrics 7 and 10 clearly depends on a number of factors, the principal of which are the gauge of the paper and the size of the stack, although the surface condition of the paper will also be of account.

Once these two eccentrics have been adjusted, operation may start with the roller 12 being rotated and sheets being fed successively from the stack 19 through the nip between the roller 12 and the lower wall 20 and then via the feed rollers 14, 15 to the main cylinder of the duplicating machine. As the height of the stack diminishes, the lower end of the plate member 2 will advance on the rollers 3 towards the roller 12, and consequently the cam surface 24 will progress forwardly and downwardly in contact with the roller 5. Due to the inclination of the cam slope 4 the plate member 2 will, as the stack 16 reduces in size, gradually increase, i.e. the obtuse angle between the lower wall 20 and the surface 6 of the sheet holder increases, and thus the increased reluctance of the sheets remaining in the stack to feed towards the nip between the roller 12 and bottom wall 20 will be compensated for by an increase in the normal reaction between the roller 12 and the top sheet which encourages slipping of the sheets.

It has been found that with the correct adjustment of the eccentrics 7 and 10 and the selection of the correct angle for the cam slopes 4, a very wide range of gauges of paper may be successfully fed using this very simple mechanism, with virtually no misfeeding of sheets. The holder 18 may be dimensioned to accept a full ream of paper (normally of the order of 2 1/2 inches thick) and when feeding from such a stack, the compensating effect obtained from the camming mechanism 23 will ensure correct feeding of all sheets from the first to the last of the stack. In order further to simplify loading of a stack of sheets into the holder the sheets may be prepacked in a special cartridge which can simply be slotted into place.

In the event of an inadvertent multiple feed the arrival of the increased thickness bunch of sheets at the nip between roller 12 and wall 20 will cause this nip to widen by virtue of the pivotal mounting of the tray 9 at b. This opening of the nip is resisted by the spring 11 so the nip will close once the bunch has passed through. No damage will be sustained by the apparatus.

While the present mechanism has been described in conjunction with a stencil duplicator, it will be apparent to those skilled in the art that such a sheet feed mechanism may be utilized for feeding sheets, not necessarily of paper, to any desired station in any form of copying machine or other sheet processing device.

I claim:

1. A feed mechanism for feeding individual sheets from a stack, the mechanism comprising: frame means; a first surface carried by said frame means for supporting an edge of a stack of sheets; a rotatable sheet feed roller adjacent to said first surface to define a nip therewith through which sheets may be fed, the axis of the sheet feed roller being parallel to said first surface; a plate member above the first support surface; a second support surface on said plate member for supporting a face of the stack of sheets; the second support surface extending at an obtuse angle to the first support surface with the said sheet feed roller included within said obtuse angle, means urging the lowermost part of the second surface towards the nip between the sheet feed roller and the first support surface; and means for supporting the plate member for rotation about an axis parallel to said first surface during advance of the plate member towards the sheet feed roller, whereby said obtuse angle increases as the spacing between the lowermost part of the second surface and the said nip decreases.

2. A feed mechanism according to claim 1, wherein, in use, the first support surface is generally horizontal.

3. A feed mechanism according to claim 1, wherein said means urging the plate member towards the said nip includes roller means on one edge of the plate member in rolling engagement with said first support surface and permitting said plate member to be gravity biased towards said nip.

4. A feed mechanism according to claim 1 and further comprising means mounted on that surface of the plate member opposite to said second support surface for defining a cam surface, the included angle between said cam surface and said first surface being greater than said obtuse angle, and means for cammingly engaging said cam surface for supporting the plate member.

5. A feed mechanism according to claim 4, wherein said means for supporting the plate member includes a roller, an arm having first and second ends, means rotatably mounting said roller on said first end of said arm, and means connecting said arm to said frame means.

6. A feed mechanism according to claim 5, wherein said means connecting said arm to said frame means includes means for adjusting the inclination of said arm with respect to said first support surface.

7. A feed mechanism according to claim 6, and including means on said arm spaced from said two ends for pivotally mounting said arm on said frame means; and an eccentric cam engaging said arm between said pivot means and said second end; and means for rotating said eccentric cam, thereby to adjust the inclination of the arm member with respect to said first support surface.

8. A feed mechanism according to claim 1, and further comprising means for varying the height of the said nip between the first support surface and the sheet feed roller.

9. A feed mechanism according to claim 8, wherein said first support surface is pivoted at a location spaced from the said nip and a rotatable eccentric cam is provided to adjust the spacing of the nip by rotating the first support surface about its pivot.

* * * * *